US008443888B2

(12) United States Patent
Coronado

(10) Patent No.: US 8,443,888 B2
(45) Date of Patent: May 21, 2013

(54) APPARATUS AND METHOD FOR PASSIVE FLUID CONTROL IN A WELLBORE

(75) Inventor: Martin P. Coronado, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 267 days.

(21) Appl. No.: 12/540,888

(22) Filed: Aug. 13, 2009

(65) Prior Publication Data

US 2011/0036578 A1 Feb. 17, 2011

(51) Int. Cl.
*E21B 43/161* (2006.01)

(52) U.S. Cl.
USPC ..... 166/305.1

(58) Field of Classification Search
None
See application file for complete search history.

(56) References Cited

U.S. PATENT DOCUMENTS

| | | | | |
|---|---|---|---|---|
| 4,315,391 | A * | 2/1982 | Piazza | 52/293.2 |
| 4,744,193 | A * | 5/1988 | Hatsuzaki et al. | 52/742.16 |
| 6,109,350 | A * | 8/2000 | Nguyen et al. | 166/281 |
| 7,013,979 | B2 | 3/2006 | Richard | |
| 7,290,606 | B2 | 11/2007 | Coronado et al. | |
| 7,409,999 | B2 | 8/2008 | Henriksen et al. | |
| 2003/0080604 | A1 * | 5/2003 | Vinegar et al. | 299/14 |
| 2004/0164499 | A1 * | 8/2004 | Murakami et al. | 277/628 |
| 2005/0205263 | A1 * | 9/2005 | Richard | 166/369 |
| 2007/0012444 | A1 * | 1/2007 | Horgan et al. | 166/278 |
| 2007/0131434 | A1 | 6/2007 | MacDougall et al. | |
| 2008/0296020 | A1 * | 12/2008 | Willauer | 166/280.1 |
| 2009/0084539 | A1 | 4/2009 | Duan et al. | |
| 2010/0038086 | A1 | 2/2010 | Bunnell et al. | |

* cited by examiner

*Primary Examiner* — Terry Melius
*Assistant Examiner* — Silvana Runyan
(74) *Attorney, Agent, or Firm* — Cantor Colburn LLP

(57) ABSTRACT

In one embodiment, a device for controlling flow of water from a subterranean formation into a production well may include a flow control member formed from a shape-conforming material and a hydrophilic polymer disposed within the shape-conforming member in an amount sufficient to cause the flow control member to restrict flow of water therethrough.

20 Claims, 4 Drawing Sheets

APPARATUS AND METHOD FOR PASSIVE FLUID CONTROL IN A WELLBORE

BACKGROUND

1. Field of the Disclosure

The disclosure relates generally to apparatus and methods for selective control of fluid flow into a production string in a wellbore.

2. Description of the Related Art

Hydrocarbons such as oil and gas are recovered from a subterranean formation using a wellbore drilled into the formation. Often the hydrocarbons are recovered from multiple hydrocarbon-bearing formations (or production zones) along the wellbore. Water is often present in the production zones along with hydrocarbons. Sometimes, water is injected into adjacent wellbores (also referred to as "injection wells") to move the hydrocarbons from the formation toward the wellbore. During later stages in the life of a production zone, the amount of water produced into the wellbore tends to continue to increase. Water breakthrough sometimes occurs. The breakthrough results in large amounts of water from nearby formation or the water injected into injection wells traveling to a production zone and thus into the wellbore.

A particular problem arises in horizontal wellbore sections that pass through a single production zone containing hydrocarbons. When fluid from different zones enters the wellbore unevenly, fluid may draw down the production hydrocarbon layer non-uniformly, causing water to be drawn into the wellbore at an accelerated rate. Producing water is undesirable because, among other things, the water occupies the valuable pipe space used to lift the hydrocarbons to the surface and moreover that the water has to be separated from the hydrocarbons and disposed of at the surface before transporting the hydrocarbons to their destination.

Flow control devices are used in association with sand screens to equalize the rate of fluid inflow into the production tubing across the productive interval. Flow control devices such as valves are used to prevent or restrict flow of the fluid from the production zone. The flow control devices restrict the flow of water along with the flow of hydrocarbons. Also, such flow control devices are complex, expensive and may require frequent maintenance.

The present disclosure provides apparatus and method for controlling flow of water into wellbores that address some of the above-noted drawbacks.

SUMMARY

In aspects the present disclosure provides systems, devices and methods for controlling the flow of water from a subterranean formation into a production tubular. In one aspect a method of making a flow device is provided that, in one embodiment, may include providing a shape-conforming member, and forming a flow control member by adding a hydrophilic polymer to the shape-conforming member in an amount sufficient to cause the flow control member to restrict flow of water In another aspect, a flow device is provided, which according to one embodiment may include a flow control member formed from a shape-conforming material and a hydrophilic polymer disposed within the shape-conforming member in an amount sufficient to cause the flow control member to restrict flow of water therethrough.

Examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims relating to this disclosure.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE EMBODIMENTS

Figure 1:
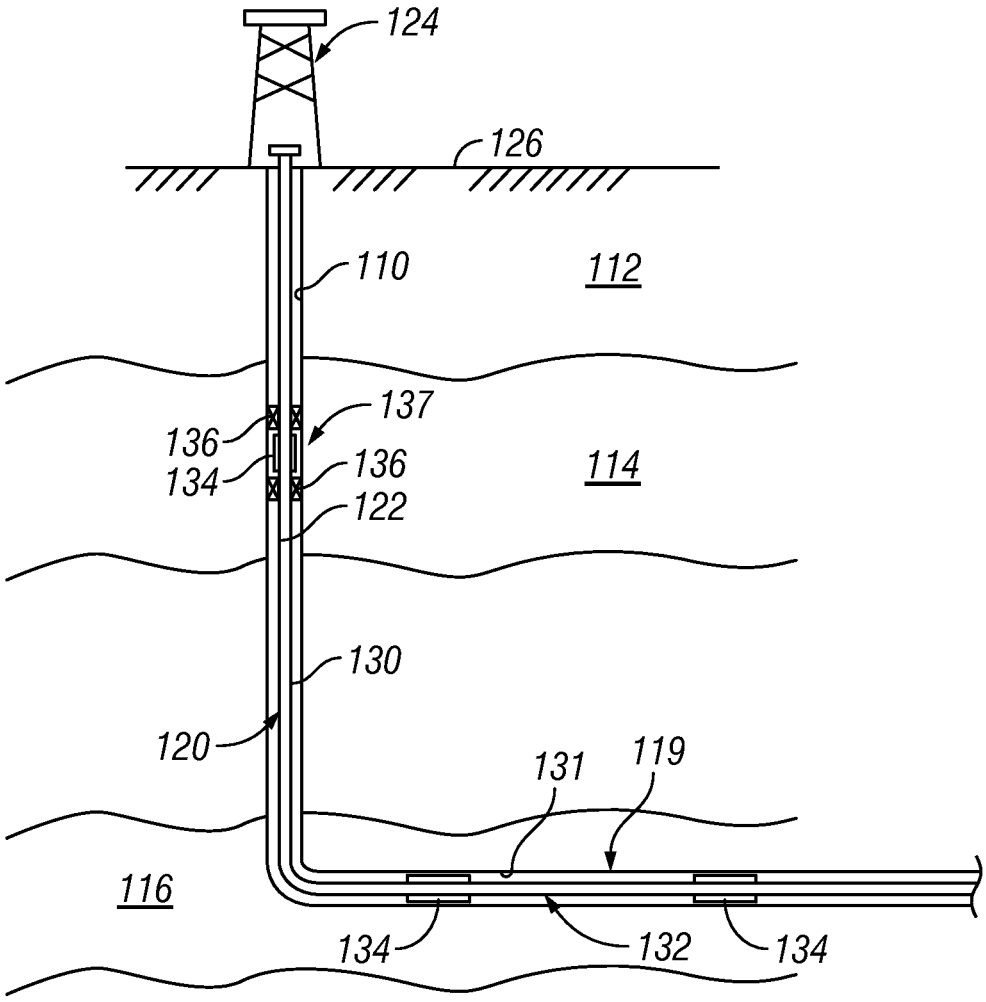
FIG. 1 is a side cross-sectional view of an exemplary open hole production assembly which incorporates flow control devices in accordance with the present invention.

The present disclosure relates to devices and methods for controlling production of hydrocarbons into wellbores. The present disclosure is susceptible to embodiments of different forms. There are shown in the drawings, and herein will be described, specific embodiments of the present disclosure with the understanding that the present disclosure is to be considered an exemplification of the principles of the devices and methods described herein and is not intended to limit the disclosure to embodiments illustrated and described herein.

FIG. 1 is a schematic diagram showing an exemplary wellbore 110 that has been drilled through the earth 112 and into a pair of formations 114, 116 from which hydrocarbon production is desired. The wellbore 110 has a deviated or substantially horizontal leg 119. The wellbore 110 has a late-stage production assembly, generally indicated at 120, disposed therein by a tubing string 122 that extends downwardly from a wellhead 124 at a surface 126 of the wellbore 110. The production assembly 120 defines an internal axial flow bore along its length. An annulus 130 is defined between the production assembly 120 and a wellbore inner surface 131. The production assembly 120 is shown to have a horizontal portion 132 that extends along the leg 119 of the wellbore 110. At selected location along the production assembly 120 are fluid control devices 134 made according embodiments discussed herein. Optionally, fluid control devices 134 are isolated within the wellbore 110 by a pair of packer devices 136, as shown in region 137.

The wellbore arrangement 110 is shown to include an uncased borehole section that is directly open to the formations 114, 116. Production fluids flow directly from the formations 114, 116 into the annulus 130 defined between the production assembly 120 and a wall of the wellbore 110. The fluid control devices 134 govern one or more aspects of fluid flow into the production assembly 120. In accordance with the present invention, the production control device 138 may have a number of alternative constructions that ensure controlled fluid flow therethrough.

Figure 2:
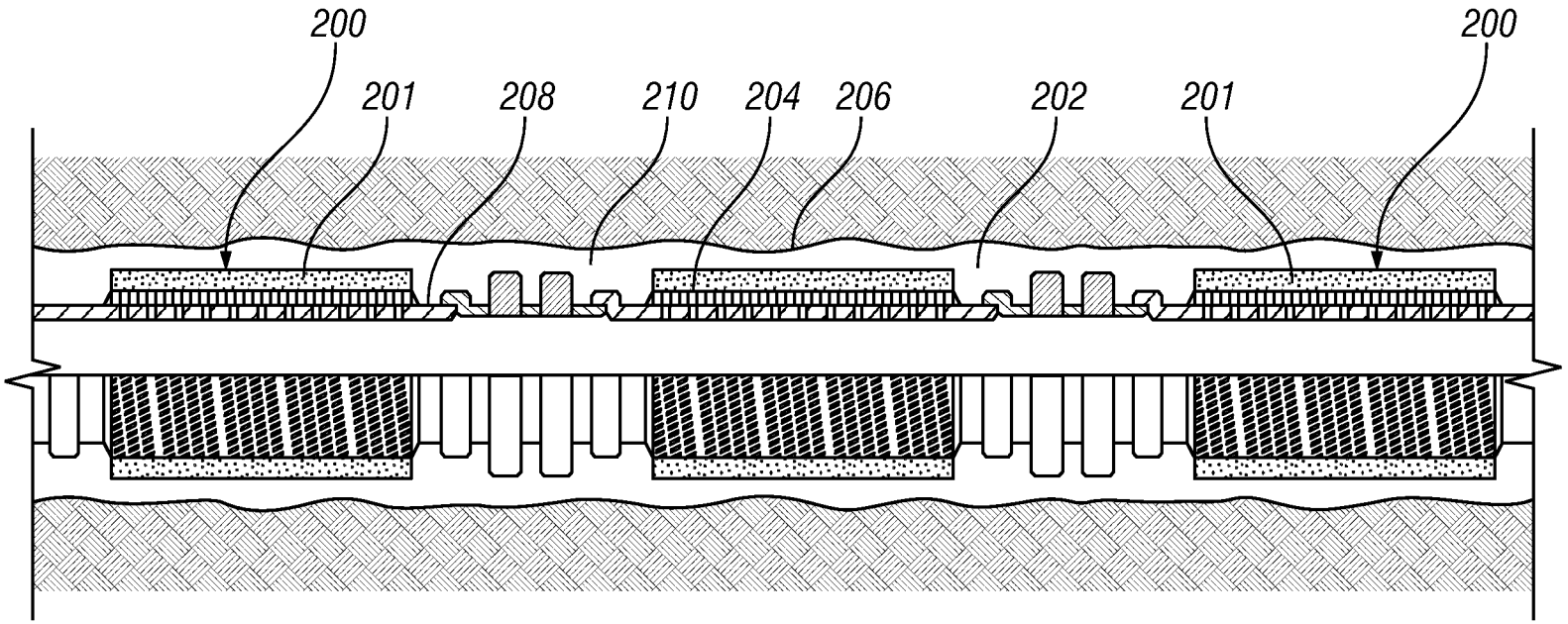
FIG. 2 is a side cross-sectional view of an exemplary flow control device, including a shape-conforming member in a compacted form in accordance with one embodiment of the present invention.

FIG. 2 shows a number of fluid control devices 200 (also referred to as the "flow control devices") placed in a wellbore section 202 for controlling the flow of fluids from a reservoir or production zone into a production string, according to one embodiment of the disclosure. FIG. 2 shows a side view with a section of the fluid control devices 200 removed to illustrate certain details. In aspects, the flow of the production fluid into the devices 200 may be a function of one or more characteristics or parameters of the formation fluid, including water content. Further, the fluid control devices 200 may be distributed in any suitable manner along a section of a production well to provide fluid control at multiple locations. Such an arrangement can be advantageous, for example, to equalize production flow in situations wherein a greater flow rate is expected at a "heel" than at a "toe" of the horizontal well. Appropriately configuring the fluid control devices 200, such as by pressure equalization or by restricting inflow of water, may increase the likelihood that an oil bearing reservoir will drain into the wellbore efficiently. Details of an exemplary fluid control device 200 are discussed herein below.

The exemplary fluid control device 200 is shown to include a flow control member 201 (also referred to as the "shape-conforming member"). In general, the shape-conforming member may be formed into a compressed shape and placed in the wellbore. Such a shape memory member expands when heated above a glass transition temperature, as described in more detail later. In aspects, the shape-conforming member 201 is permeable. In one aspect, the shape-conforming member 201 includes one or more additives that expand when exposed to certain fluids, such as water, thereby reducing the permeability of the shape-conforming member 201. The reduced permeability reduces the flow of the fluid therethrough, including water. The formation of such a shape-conforming member is described later.

Still referring to FIG. 2, in one aspect, the shape-conforming member 201 may be placed on an outer surface of a screen member 204. The shape-conforming member 201 is shown in a compressed state so that it may be conveyed into the wellbore and placed at a selected location in the wellbore. As described below, the shape-conforming member 201 may expand when heated in the wellbore to contact a borehole 206 surface, thereby positioning and securing the fluid control device in the selected wellbore location. In aspects, the screen member 204 may include a suitable wire mesh or a similar durable fluid filter device. In one configuration, the screen member 204 may be located on an outer surface of a tubular or pipe member 208, which includes fluid passages configured to receive the fluid into the tubular member and direct the production fluid to the surface. In FIG. 2, the shape-conforming member 201 is shown located on an outer surface of the screen member 204. In another embodiment, the shape-conforming member 201 may be located on the outer surface of the tubular member 208. In yet another embodiment, a standoff structure or a fluid flow path may be provided along an outer surface of the tubular 208 to facilitate the flow of the production fluid from the shape-conforming member 201 to the tubular 208.

In the exemplary embodiment of FIG. 2, a plurality of fluid control devices 200 are shown located adjacent to one another in the horizontal leg of a wellbore. There may be packers or other components located in spaces 210 between the fluid control devices 200. The packers may be used to isolate production zones or sections of a horizontal wellbore. In accordance with embodiments of the present disclosure, the flow control device 200 may have a number of alternative constructions that provide desired controlled fluid flow therethrough. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. Additionally, references to water should be construed to also include water-based fluids; e.g., brine or salt water.

Still referring to FIG. 2, the flow control device 200 may have a number of alternative constructions to control fluid flow therethrough. Various materials may be used to construct the components of the flow control device 200, including metal alloys, steel, polymers, foams, composites, any suitable durable and strong material, or any combination thereof. As depicted herein, the illustrations shown in the figures are not to scale. Assemblies or individual components vary in size and/or shape depending on desired filtering, flow, or other application specific criteria. Further, some illustrations may feature certain components removed to enhance clarity and detail.

In general, the shape-conforming member 201 may be formed from any suitable material that controls the flow of water from the formation to the wellbore. In an aspect, the shape-conforming member 201 may be formed using a polymeric foam of an open cell structure. Such a cell-based member is permeable and allows fluids to pass through open cells and thus through the foam member. Such a shape-conforming member may be described as an open cell member that is substantially permeable or porous. The types of materials that may be suitable for preparing the shape-conforming member may include any material that is able to withstand typical downhole conditions without undesired degradation. In non-limiting embodiments, such material may be prepared from a thermoplastic or thermoset medium. This medium may contain a number of additives and/or other formulation components that alter or modify the properties of the resulting shape-conforming material. For example, in some non-limiting embodiments the shape-conforming material may be either thermoplastic or thermoset in nature, and may be selected from a group comprising polyurethanes, polystyrenes, polyethylenes, epoxies, rubbers, fluoroelastomers, nitrites, ethylene propylene diene monomers (EPDM), other polymers, combinations thereof, and the like.

In certain non-limiting embodiments the shape-conforming member 201 may have a "shape memory" property. Therefore, the shape-conforming member 201 may also be referred to as a shape memory member. As used herein, the term "shape memory" refers to the capacity of the material to be heated above the material's glass transition temperature, and then be compressed and cooled to a lower temperature while still retaining its compressed state. However, it may then be returned to its original shape and size, i.e., its pre-compressed state, by reheating it close to or above its glass transition temperature. This subgroup, which may include certain syntactic and conventional foams, may be formulated to achieve a desired glass transition temperature for a given application. For instance, a foaming medium may be formulated to have a transition temperature just slightly below the anticipated downhole temperature at the depth at which it will be used, and the material then may be blown as a conventional foam or used as the matrix of a syntactic foam.

The initial (as-formed) shape of the shape-conforming member may vary, though an essentially tubular shape is usually well-suited to downhole wellbore deployment as part of a fluid control device, as discussed herein. The shape-conforming member may also take the shape of a sheet or layer, which may be wrapped around a production pipe as a component of a fluid or sand control apparatus. Concave ends, striated areas, etc., may also be included in the design to facilitate deployment, or to enhance the filtration characteristics of the layer. In the latter case, the design may serve a sand control purpose. In one aspect, hydrophilic polymers may be added to the shape-conforming member prior to run in to the wellbore. The hydrophilic polymers are added while the shape-conforming member is heated above its glass transition temperature, wherein the polymer is positioned within open cells of the foam which makes up the shape-conforming member. In one aspect, the hydrophilic polymers may be added to the shape-conforming member when it is below the glass transition temperature. Further, the shape-conforming member is then compacted and cooled to a second shape for a wellbore run in process. For the purposes of this disclosure, the shape-conforming member may also be referred to as a flow control member or device, in-flow control member, reactive media member, or water flow control member.

In embodiments, the flow control member may include a water sensitive media. One non-limiting example of a water sensitive media is a Relative Permeability Modifier (RPM). The Relative Permeability Modifier may be a hydrophilic polymer. Such a polymer may be used alone or in conjunction with a permeable filtering material having passages for the polymer. To obtain a desired permeability or reactivity for a given input, such as in-flowing fluid with a particular amount of water (water cut), the properties of the water-sensitive material may be varied by changing the polymer (type, composition, combinations, etc), the permeable material (type, size of fluid passages, shape, combinations, etc) or the composition of the two (amount of polymer, method of bonding, configurations, etc). In one non-limiting example, water flowing into, around or through the hydrophilic material within a permeable open cell foam member expands to reduce the available cross-sectional flow area in the shape-conforming member. This increases resistance to fluid flow. When the amount of water flow through the permeable media decreases, the hydrophilic polymers shrink or contract to open the flow channel for the fluids.

For the purposes of this disclosure, the hydrophilic polymers may be formed from any suitable component with a strong affinity for water, thereby enabling the polymer to bond and swell in size when exposed to a certain amount of water, and, in turn, to contract when not exposed to the predetermined amount of water. Accordingly, the volume of the hydrophilic polymers increases, or expands, when contacted by a predetermined or selected amount of water flowing from the formation. The selected amount of water that causes the expansion of the hydrophilic polymers may be based on a flow rate, percentage of water in a fluid, or another parameter representative of an exposure to a selected amount of water. In one aspect, the type and size of hydrophilic polymer is configured according to the desired permeability of an application. For example, a dense open cell foam may only use a limited amount of a thinner hydrophilic polymer to restrict a water flow through the fluid channels of the foam.

As described below, after the shape-conforming member 201 expands to conform to a borehole. When a shape-conforming member is used as a fluid control device, it is preferred that the device remain in a compressed state during run-in until it reaches the desired downhole location. Usually transporting downhole tools from the surface to the desired downhole location requires hours or days. When temperatures experienced during run-in are sufficiently high, the filtration devices made from the shape-memory polyurethane foam could start to expand. To avoid undesired expansion during run-in, methods of delaying heating the foam may be utilized. In one specific, but non-limiting embodiment, polyvinyl-alcohol (PVA) film may be used to wrap or cover the outside surface of devices made from shape-memory polyurethane foam to prevent expansion during run-in. Once filtration devices are in place in a borehole for a given amount of time at a certain range of temperatures, the PVA film dissolves in the water, emulsions or other downhole fluids and, after such exposure, the shape-memory devices expand and conform to the bore hole. In another alternative but non-restrictive embodiment, the filtration devices made from the shape-memory polyurethane foam may be coated with a thermally fluid-degradable rigid plastic such as polyester polyurethane plastic and polyester plastic. The term "thermally fluid-degradable plastic" refers to any rigid solid polymer film, coating or covering that is degradable when subjected to a fluid, e.g. water or hydrocarbons or a combination thereof and heat. The covering is formulated to be degradable within a particular temperature range to meet the required application or downhole temperature at the required period of time (e.g. hours or days) during run-in. The thickness of the covering intended to delay expansion and the type of degradable plastics are parameters that may be selected to prevent filtration devices of shape-memory polyurethane foam from expanding during run-in. Once the filtration device is in place downhole for a given amount of time at a certain range of temperature, these degradable plastics decompose. This allows the filtration devices to expand to the inner wall of the bore hole. In other words, the covering that inhibits or prevents the shape-memory porous material from returning to its expanded position or from being prematurely deployed may be removed by dissolving it, e.g. in an aqueous or hydrocarbon fluid, or by thermal degradation or hydrolysis, with or without the application of heat. In one embodiment, the hydrophilic polymer, that may be added to a shape-conforming foam of the shape-conforming member, via injection or other suitable means, is positioned within open cells of the foam.

Hydrophilic polymers may also be referred to as hydrophilic materials, wherein any suitable material exhibiting hydrophilic characteristics may be utilized. Hydrophilic polymers may be composed of any suitable component with a strong affinity for water, thereby enabling the polymer to bond and swell in size when exposed to a certain amount of water, and, in turn, contract when not exposed to the predetermined amount of water. Accordingly, the volume of the hydrophilic polymers increases, or expands, when contacted by a predetermined or selected amount of water flowing from the formation. The selected amount of water that causes the expansion of the hydrophilic polymers may be based on a flow rate, percentage of water in a fluid, or another parameter. In one aspect, polymers such as polyvinyl alcohol and vinyl sulfonate may be used in a suitable amount. In one embodiment the polymer loading may be between 2-4%. In one method, the polymer may be injected into the foam at a pressure to saturate or substantially saturate the foam pore spaces. The polymer is bonded to the foam material. The rate of expansion may be selectively chosen. However, as the water content in the fluid increases in the production fluid, an increasing amount of the polymer swells as more cells in the foam material come in contact with water.

Figure 3:
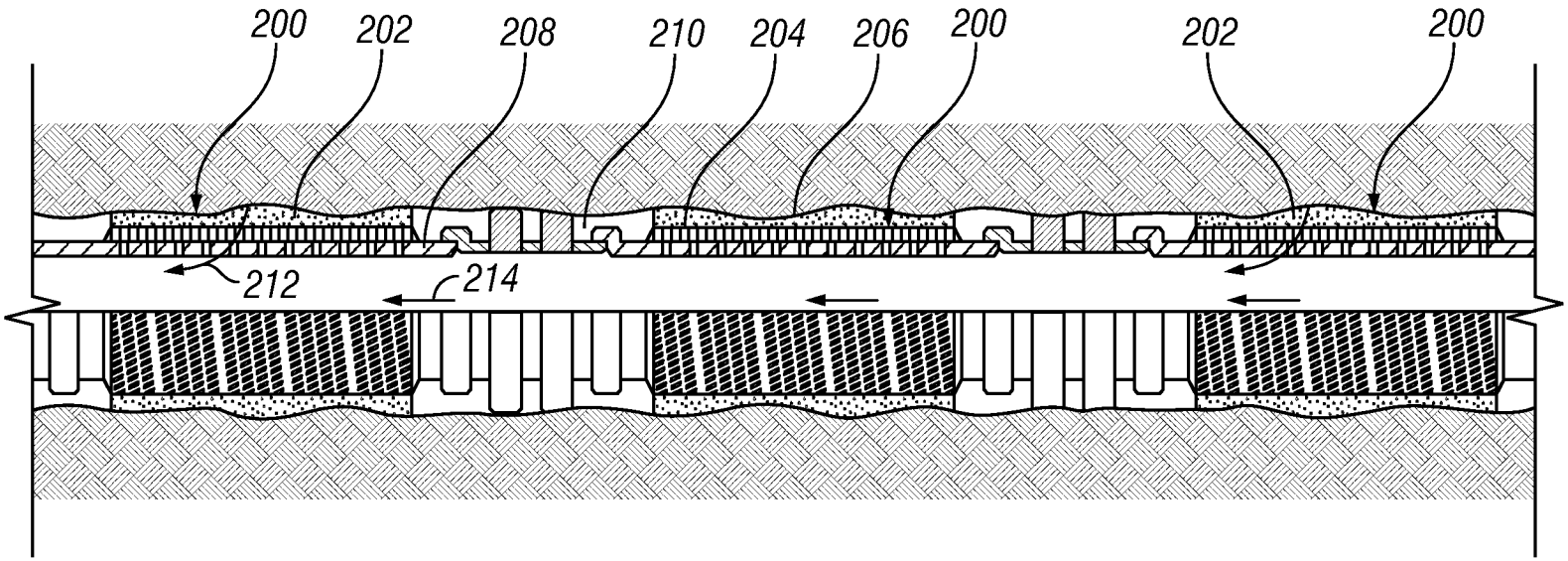
FIG. 3 is a side cross-sectional view of an exemplary flow control device, including a shape-conforming member in an expanded form in accordance with one embodiment of the present invention.

FIG. 3 shows a sectional side view of the exemplary flow control devices 200 after the shape-conforming members 201 (shown in FIG. 2) have expanded. For convenience, the expanded shape-conforming members are denoted by numeral 202. The illustration shows each flow control device 200 at a selected location within the wellbore, wherein the shape-conforming member 202 conforms to the inner surface of the wellbore 206. Because the flow control devices 200 may be generally similar in nature, for convenience, reference may be made to a single flow control device 200. Accordingly, each flow control device 200 is configured to enable the formation fluid to flow, as shown by an arrow 212, through the shape-conforming member 202, the screen material 204, and tubular 208. The formation fluid then flows axially 214 towards the wellbore surface. In an aspect, the shape-conforming members 202 are heated at or above a glass transition temperature, thereby causing the members to expand and conform to the walls of wellbore 206. Accordingly, hydrophilic polymers within the shape-conforming members 202 enable hydrocarbon fluid to flow through the substantially permeable members. When water flows from the formation into the shape-conforming members 202, the hydrophilic polymer located within cells, expands to increase resistance to water flow through the members. The hydrophilic polymers expand upon contact with a selected amount of water, thereby "clogging" the open cells and fluid communication passages of the open cell foam. In one aspect, when the water exposure is below a selected amount and hydrocarbon fluids, such as substantially entirely hydrocarbon (oil and/or gas) flow through the shape-conforming members, the hydrophilic polymers shrink (or reduce in volume) to open the fluid communication channels for oil and/or gas flow. Accordingly, the hydrophilic polymers located in the shape-conforming members 202 enable fluid flow control for the flow control devices 200.

Figure 4:
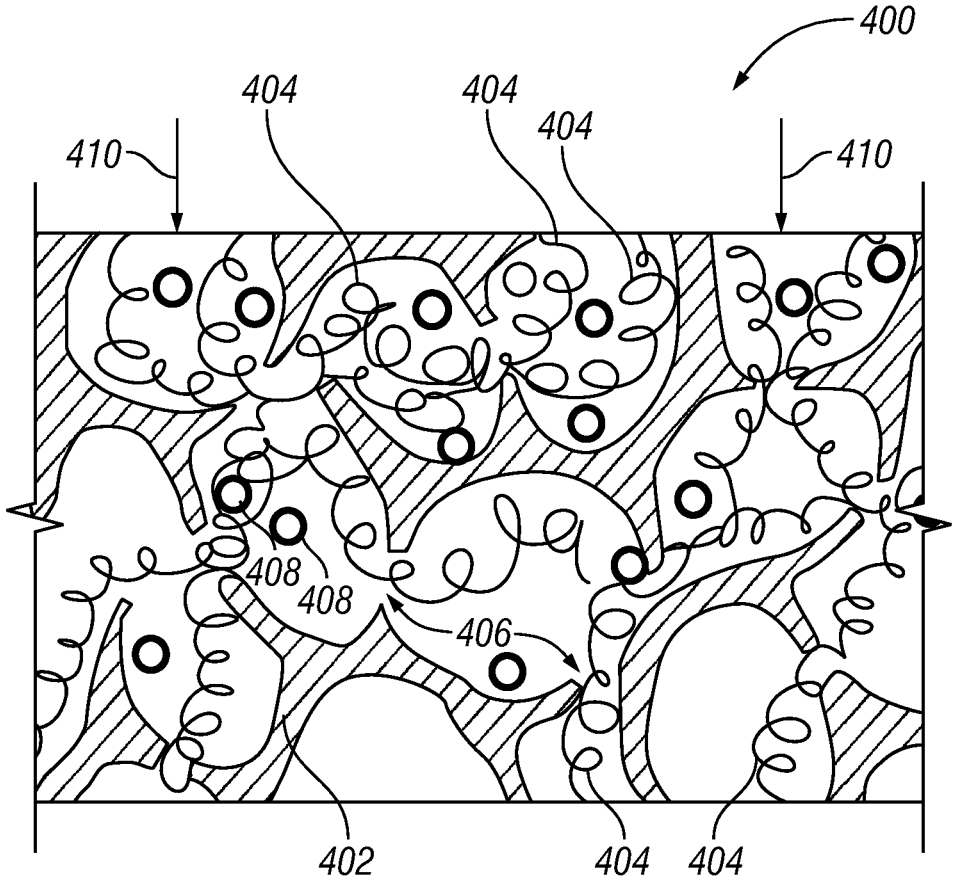
FIG. 4 is a detailed side view of a portion of an exemplary flow control device, including a permeable foam with a hydrophilic polymer, in accordance with one embodiment of the present invention.

FIG. 4 is a view of a portion of an exemplary flow control device 400, including a permeable foam structure 402 and hydrophilic polymer 404. In an aspect, the hydrophilic polymer 404 is located in fluid passages and cells within the open cell foam structure 402 and bonded to the cell walls. The hydrophilic polymer 404 may be added to the foam structure 402 by injection, during formation of the foam, or any other suitable method. As depicted, the hydrophilic polymer 404 is located in openings 406 in the foam structure 402. The hydrophilic polymer 404 expands when water molecules 408 are sensed in a fluid flow 410 from the formation. Accordingly, the combination of the hydrophilic polymer 404 and foam structure 402 provide a selective flow resistance for the flow control device 400. Further, the configuration of the foam structure 402 and hydrophilic polymer 404 enables a durable bond and a substantially reduced relative flow velocity due to the relatively large contact area with the wellbore.

In addition, the flow control device "conforms" to the wellbore, that the shape-conforming member expands or deploys to fill the available space up to the wellbore wall. The wellbore wall limits the final, expanded shape of the shape-conforming permeable material and, in fact, will not permit it to expand to its original, expanded position or shape. In this way however, the expanded or deployed shape-conforming member as a component of the fluid control device, being porous, will permit hydrocarbons to be produced from a subterranean formation through the wellbore. In another aspect, the foam member of a fluid control device may be composed of a non shape-conforming permeable material. The material may contain fluid communication channels with hydrophilic polymers configured to restrict a flow of water, as discussed above.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A method of making a flow device to control flow of fluid from a formation, comprising:

providing a shape-conforming material with an open cell structure; forming a flow control member by injecting a hydrophilic polymer in openings in the open cell structure of the shape-conforming material in an amount sufficient to cause the flow control member to restrict flow of water therethrough, wherein the hydrophilic polymer is bonded to cell walls of the shape-conforming material and is positioned within openings in the open cell structure to restrict flow of water through the openings.

2. The method of claim 1, further comprising:

heating the shape-conforming material to attain a first shape prior to adding the hydrophilic material; and compacting and cooling the flow control member after adding the hydrophilic material to cause the flow control member to attain a second shape.

3. The method of claim 1, wherein the hydrophilic polymer expands within the flow control member in response to exposure to an amount of water.

4. The method of claim 1, further comprising: compacting the flow control member; and adding the hydrophilic material into the flow control member after compacting the flow control member.

5. The method of claim 1, wherein providing shape-conforming material comprises providing a substantially permeable foam.

6. The method of claim 1, further comprising placing the flow control member outside a tubular member having passages therein.

7. The method of claim 6, further comprising providing a fluid flow path between the tubular and the flow control member.

8. A flow control device to control flow of fluid from a formation, comprising:

a flow control member formed from a shape-conforming material with an open cell structure and a hydrophilic polymer injected in openings in the open cell structure of the shape-conforming material in an amount sufficient to cause the flow control member to restrict flow of water therethrough, wherein the hydrophilic polymer is bonded to cell walls of the shape-conforming material and is positioned within openings in the open cell structure to restrict flow of water through the openings.

9. The flow control device of claim 8, wherein the hydrophilic polymer restricts flow of water in response to exposure to the amount of water.

10. The flow control device of claim 8, wherein the flow control member is configured to expand when placed in a wellbore to contact a wall of the wellbore.

11. The flow control device of claim 8, further comprising a tubular member with at least one fluid passage therein.

12. The flow control device of claim 11, further comprising a metallic mesh between the tubular and the flow control member.

13. The flow control device of claim 11, further comprising a fluid path between the tubular and the flow control member.

14. A method of producing a fluid from a formation into a wellbore, comprising:

providing a flow control device that includes a flow control member formed from a shape-conforming material with an open cell structure and a selected amount of a hydrophilic polymer injected in the open cell structure of the shape-conforming material sufficient to cause the flow control member to restrict flow of water therethrough, wherein the hydrophilic polymer is bonded to cell walls of the shape-conforming material and is positioned within openings in the open cell structure to restrict flow of water through the openings;

placing the flow control device with the flow control member in a first compacted shape at a selected location in the wellbore;

allowing the flow control member to attain a second expanded shape; and producing the fluid from the formation into the wellbore by flowing the fluid through the flow control device.

15. The method of claim 14, wherein the hydrophilic polymer expands within the flow control member in response to exposure to an amount of water to restrict flow of water therethrough.

16. The method of claim 14, wherein the shape-conforming material comprises a substantially permeable foam.

17. The method of claim 14, wherein allowing the flow control member to attain a second expanded shape further comprises heating the shape-conforming material above a glass transition temperature.

18. The method of claim 14, wherein providing the flow control device further comprises providing the flow control member outside a tubular having at least one passage configured to enable the fluid to enter into the tubular.

19. The method of claim 18, wherein providing the flow control device further comprises providing a fluid flow path between the tubular and the flow control member.

20. The method of claim 19, wherein providing the flow control device further comprises providing a metallic mesh between the tubular and the flow control member or outside the flow control member.

* * * * *